US009417578B1

(12) United States Patent
Takano et al.

(10) Patent No.: US 9,417,578 B1
(45) Date of Patent: Aug. 16, 2016

(54) IMAGE FORMING APPARATUS AND IMAGE FORMING METHOD

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventors: Taishi Takano, Shizuoka (JP); Maiko Yoshida, Shizuoka (JP); Satoshi Araki, Shizuoka (JP); Takashi Urabe, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/932,020

(22) Filed: Nov. 4, 2015

(51) Int. Cl.
*G03G 15/20* (2006.01)

(52) U.S. Cl.
CPC ..... *G03G 15/2089* (2013.01)

(58) Field of Classification Search
CPC ..... G03G 15/2089
USPC ..... 399/67
See application file for complete search history.

(56) References Cited

U.S. PATENT DOCUMENTS

2015/0132697 A1 5/2015 Yoshida et al.

*Primary Examiner* — David Bolduc
*Assistant Examiner* — Barnabas Fekete
(74) *Attorney, Agent, or Firm* — Amin, Turocy & Watson LLP

(57) ABSTRACT

An object of the present invention is intended to provide an image forming apparatus and an image forming method through which an effect of granting flavor to a printing object is excellent. In accordance with an embodiment, an image forming apparatus comprises a developing device and a fixing device. A toner is housed in the developing device. The fixing device includes a fixing roller and a pressure roller. The toner contains binder resin and a microcapsule in which perfume is encapsulated. A glass transition temperature of the toner is below 60 degrees centigrade. A nip part is formed by the fixing roller and the pressure roller. A pressure applied to an image receiving medium passing through the nip part is below 0.19 N/mm$^2$.

10 Claims, 3 Drawing Sheets

| | IMAGE FORMING APPARATUS | | | | | | | EVALUATION |
|---|---|---|---|---|---|---|---|---|
| | DEVELOPING DEVICE | | FIXING DEVICE | | | | | |
| | CATEGORY OF TONERS HOUSED IN DEVELOPING DEVICE | Tg OF TONER (DEGREES CENTIGRADE) | CATEGORY OF FIXING DEVICES | SPONGE HARDNESS (DEGREES) | ENERGIZING FORCE GENERATED BY PRESSURE SPRING (N) | NIP PART WIDTH (mm) | PRESSURE APPLIED TO IMAGE RECEIVING MEDIUM PASSING THROUGH NIP PART (N/mm²) | FLAVOR OF PRINTING OBJECT |
| EXAMPLE 1 | TONER (1) | 54 | FIXING DEVICE (1) | 40 | 400 | 7.7 | 0.16 | A |
| EXAMPLE 2 | TONER (1) | 54 | FIXING DEVICE (2) | 40 | 500 | 8.4 | 0.19 | A |
| COMPARATIVE EXAMPLE 1 | TONER (1) | 54 | FIXING DEVICE (3) | 45 | 500 | 7.4 | 0.21 | B |
| COMPARATIVE EXAMPLE 2 | TONER (2) | 63 | FIXING DEVICE (1) | 40 | 400 | 7.7 | 0.16 | C |
| COMPARATIVE EXAMPLE 3 | TONER (2) | 63 | FIXING DEVICE (3) | 45 | 500 | 7.4 | 0.21 | C |

FIG.3

IMAGE FORMING APPARATUS AND IMAGE FORMING METHOD

FIELD

Embodiments described herein relate generally to an image forming apparatus and an image forming method.

BACKGROUND

In recent years, a demand for high added-value printing is increasing. For example, there is a requirement for a printing object capable of volatilizing perfume from image part formed on an image receiving medium for a long period of time.

In an offset printing or a screen printing, in order to obtain the printing object capable of volatilizing perfume, an ink composition added with a microcapsule which encapsulates the perfume is used.

On the other hand, the ink composition is unsuitable to a variable printing in which printing is carried out while print contents are changed like a direct mail.

In such a variable printing, a digital printing press is useful, for example, an electrophotographic type image forming apparatus is used. In the electrophotographic type image forming apparatus, a toner image transferred onto the image receiving medium is heated, pressed and cooled by a fixing device to be fixed. However, by heating the toner image, there is a case in which the perfume encapsulated in the microcapsule is evaporated before the fixing processing. Further, by pressing the toner image, there is a case in which the microcapsule is destroyed. Therefore, there is a possibility that an effect of granting flavor to the printing object is sufficiently obtained.

BRIEF DESCRIPTION OF THE DRAWINGS

FIG. 3 is a diagram illustrating evaluation results of flavor of a printing object and the image forming apparatus of each example.

DETAILED DESCRIPTION

Figure 1:
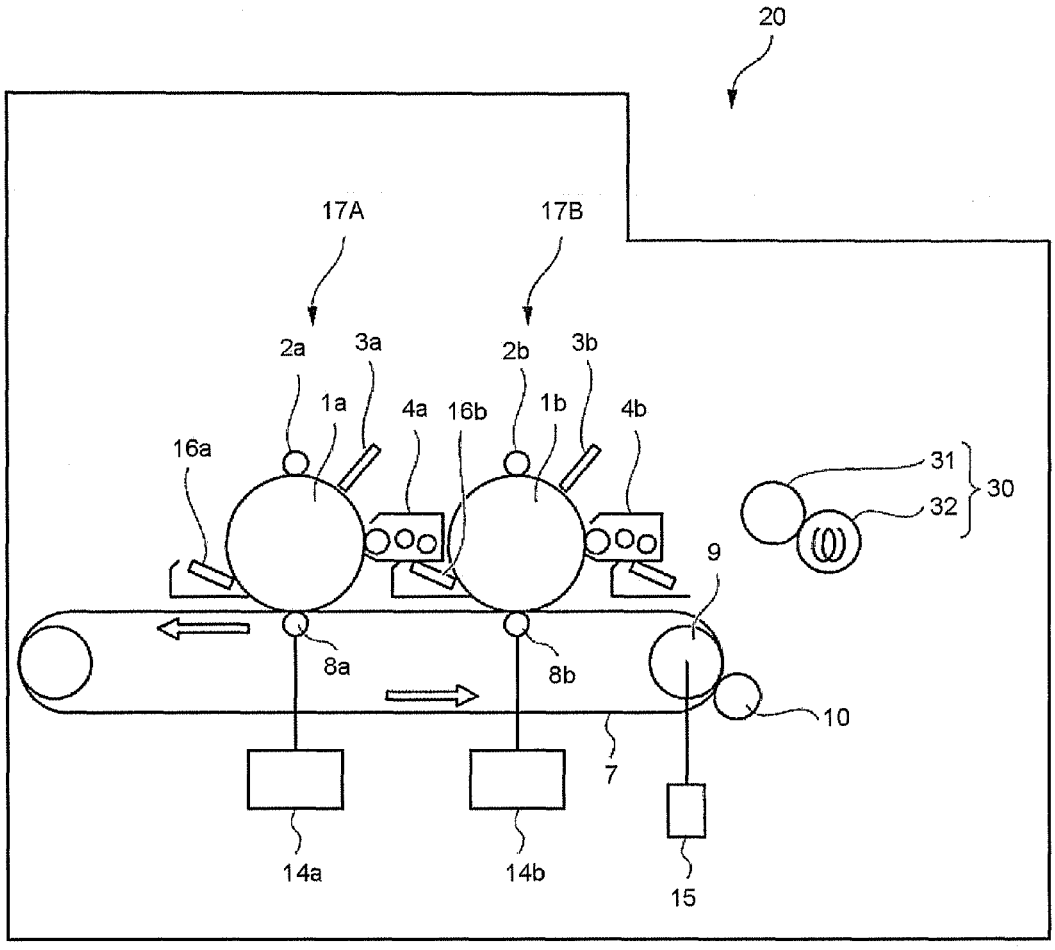
FIG. 1 is a diagram illustrating an embodiment of an image forming apparatus.

Hereinafter, an image forming apparatus according to an embodiment is described.

In accordance with the embodiment, the image forming apparatus comprises a developing device and a fixing device. A toner is housed in the developing device. The fixing device includes a fixing roller and a pressure roller. The toner contains a microcapsule which encapsulates perfume (perfume encapsulation microcapsule) and a binder resin. A glass transition temperature (Tg) of the toner is below 60 degrees centigrade. In the image forming apparatus of the embodiment, a nip part is formed by the fixing roller and the pressure roller, and a pressure applied to the image receiving medium passing through the nip part is below 0.19 N/mm$^2$.

Hereinafter, the toner of the embodiment is described.

The toner of the embodiment contains the perfume encapsulation microcapsule and the binder resin.

Tg of the toner is below 60 degrees centigrade, preferably 25~60 degrees centigrade, and more preferably 25~55 degrees centigrade.

If Tg of the toner is below a upper limit value of the foregoing range, an toner image is easier to be fixed at a lower temperature. In this way, the perfume is easier to be kept in the toner and an effect of granting flavor to the printing object is increased. On the other hand, if Tg of the toner is above a preferable lower limit value of the foregoing range, a storage stability of the toner is easier to be guaranteed.

In the present specification, the glass transition temperature (Tg) is a value obtained by a differential scanning calorimetry. It is assumed that Tg of the toner is a temperature of a point of intersection of a tangent at a inflection point (a point at the upper portion of which a convex curve is changed into a convex curve at the lower portion thereof) and a base line of a DSC curve by carrying out the differential scanning calorimetry for the toner itself serving as a sample. Tg of the toner is mainly controlled by the selection of the binder resin.

A volume average particle diameter of the toner is preferably 3~20 μm, and more preferably 3~15 μm.

In the present specification, the volume average particle diameter is a value measured by, for example, a coulter multisizer III (manufactured by Beckman Coulter, Inc.).

Hereinafter, the perfume encapsulation microcapsule is described.

The perfume encapsulation microcapsule is used to encapsulate the perfume in the microcapsule.

The volume average particle diameter of the perfume encapsulation microcapsule is preferably 0.10~10 μm, and more preferably 0.50~5 μm.

If the volume average particle diameter of the perfume encapsulation microcapsule is above a preferable lower limit value of the foregoing range, the microcapsule is easily destroyed and the perfume is easily volatilized. On the other hand, if the volume average particle diameter of the perfume encapsulation microcapsule is below a preferable upper limit value of the foregoing range, it is easy to suppress that the particle diameter of the toner is excessively large and to obtain a good image in a case of the toner image particularly.

The perfume encapsulated in the microcapsule is not particularly limited; however, a liquid perfume ingredient is preferable from the viewpoint of easy volatilization.

Oily perfume or diluted solution thereof is exemplified as such a liquid perfume ingredient.

Natural perfume or synthetic compound perfume is used in the oily perfume. For example, as the oily perfume, brominated styrene, phenyl ethyl alcohol, linalool, hexylcinnamic aldehyde, α-limonene, benzyl aldehyde, eugenol, bornyl aldehyde, citronellal, kororaru, terpineol, geraniol, menthol, and cinnamic acid are exemplified.

As the diluted solution of the oily perfume, it is exemplified that the natural perfume or the synthetic compound perfume is diluted with a solvent. Benzyl benzoate and the like is exemplified as the solvent. Further, odorless solvent is preferable for the solvent.

One kind of perfume may be used singly; alternatively, more than or equal to two kinds of perfumes may be combined to be used.

As materials used in a wall film (film) of the microcapsule, urea-formaldehyde resin, melamine-formaldehyde resin, guanamine-formaldehyde resin, sulfonamide-aldehyde resin, aniline-formaldehyde resin, and urethane resin are exemplified. Even among these materials, at least one kind of material selected from a group consisting of melamine-formaldehyde resin and urethane resin is preferable as the material used in a wall film (film) of the microcapsule. In particular, the melamine-formaldehyde resin is preferable as the material used in a wall film (film) of the microcapsule from the viewpoint of the excellent water resistance, chemical resistance, solvent resistance or aging resistance.

The perfume encapsulation microcapsule is manufactured by the encapsulation of perfume.

In the encapsulation of perfume, the usage amount of the materials of the wall film (film) is preferably 10~100 pts·mass, and more preferably 20~50 pts·mass with respect to 100 pts·mass of perfume.

For example, an interfacial polymerization method, a coacervation method, an in-situ polymerization method, a drying method in liquid, a cured coated film method in liquid and the like are adopted as methods of the encapsulation of perfume.

Even within these methods mentioned above, the in-situ polymerization method and the interfacial polymerization method are preferable as the methods of the encapsulation of perfume.

Even in the in-situ polymerization method, an in-situ polymerization method using melamine-formaldehyde resin as the material of the wall film (film) is more preferable.

In a case of the in-situ polymerization method, first, oily perfume or diluted solution thereof and water-soluble polymer or aqueous solution of surfactant are emulsified to obtain emulsion dispersion liquid. Then, melamine-formalin prepolymer aqueous solution is added in the emulsion dispersion liquid and heated to carry out polymerization. In this way, the perfume is encapsulated. At this time, it is preferable that the melamine-formalin prepolymer aqueous solution is added separately and polymerization is continued. At the time the melamine-formalin prepolymer aqueous solution is added, pH of system may be adjusted to acidification as necessary.

Even in the interfacial polymerization method, an interfacial polymerization method using urethane resin as the material of the wall film (film) is more preferable.

In a case of the interfacial polymerization method, first, oily perfume or diluted solution thereof and polyvalent isocyanate prepolymer are mixed to obtain solution. Next, the forgoing solution and water-soluble polymer or aqueous solution of surfactant are emulsified to obtain emulsion dispersion liquid. Then, multivalent base such as diamine or diol is added and heating polymerization is carried out in the emulsion dispersion liquid. In this way, the perfume is encapsulated.

As stated above, dispersion liquid is manufactured by dispersing the perfume encapsulation microcapsule.

One kind of the perfume encapsulation microcapsule may be used singly; alternatively more than or equal to two kinds of the perfume encapsulation microcapsules may be combined to be used.

The content of the perfume encapsulation microcapsule is preferable 1~20 mass %, and more preferably 3~10 mass % with respect to the total amount (100 mass %) of the toner.

Hereinafter, binder resin is described.

Polyester resin, polystyrene resin, polyurethane resin, epoxy resin and the like are exemplified as binder resin.

It is preferable that polyester resin uses ≥2 valent alcohol component and ≥2 valent carboxylic acid component as raw material monomer.

As a divalent alcohol component, alkylene oxide adducts of bisphenol A such as polyoxypropylene (2.2)-2,2-bis(4-hydroxyphenyl) propane, polyoxypropylene (3.3)-2,2-bis (4-hydroxyphenyl) propane, polyoxyethylene (2.0)-2,2-bis (4-hydroxyphenyl) propane, polyoxypropylene (2.0)-polyoxyethylene (2.0)-2,2-bis(4-hydroxyphenyl) propane, polyoxypropylene (6)-2,2-bis(4-hydroxyphenyl) propane and the like; ethylene glycol, diethylene glycol, triethylene glycol, 1,2-propylene glycol, 1,3 propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, and hydrogenated bisphenol A are exemplified. Among these components, as the divalent alcohol component, alkylene oxide adducts of bisphenol A, ethylene glycol, 1,2-propylene glycol, 1,3-propylene glycol, 1,6-hexanediol, bisphenol A, and hydrogenated bisphenol A are preferable. As alkylene oxide adducts of bisphenol A, alkylene (carbon number 2 or 3) oxide adducts (average addition mole number 1~10) of bisphenol A is preferable.

As ≥3 valent alcohol component, sorbitol, 1,2,3,6-hexanetetrol, 1,4-sorbitan, pentaerythritol, dipentaerythritol, tripentaerythritol, 1,2,4-butanetriol, 1,2,5-pentane triol, glycerol, 2-methylpropanetriol, 2-methyl-1,2,4-butanetriol, trimethylolethane, trimethylolpropane, and 1,3,5-trihydroxy methyl benzene are exemplified. Among these components, as ≥3 valent alcohol component, sorbitol, 1,4-sorbitan, pentaerythritol, glycerol and trimethylol propane are preferable.

One kind of ≥2 valent alcohol component may be used singly, and more than or equal to two kinds of ≥2 valent alcohol components are combined to be used.

As ≥2 valent carboxylic acid component, ≥2 valent carboxylic acid, carboxylic acid anhydride and carboxylic acid ester are exemplified.

As divalent carboxylic acid component, maleic acid, fumaric acid, citraconic acid, itaconic acid, glutaconic acid, phthalic acid, isophthalic acid, terephthalic acid, cyclohexane dicarboxylic acid, succinic acid, adipic acid, sebacic acid, azelaic acid, malonic acid, or alkenyl succinic acid such as n-dodecenyl succinic acid, alkyl succinic acid such as n-dodecyl succinic acid or their acid anhydrides, or lower alkyl ester and the like are exemplified. Even among these acids, as divalent carboxylic acid component, maleic acid, fumaric acid, terephthalic acid and alkenyl succinic acid are preferable. As alkenyl succinic acid, succinic acid substituted with alkenyl group of 2~20 carbon atoms.

As ≥3 valent carboxylic acid component, 1,2,4-benzenetricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-carboxyl-2-methyl-2-methylene carboxy propane, 1,2,4-cyclohexane tricarboxylic acid, tetra(methylene carboxyl) methane, 1,2,7,8-octane tetracarboxylic acid, pyromellitic acid, Empol trimer acid or their acid anhydrides, or lower alkyl ester and the like are exemplified. Even among these acids, as ≥3 valent carboxylic acid component, 1,2,4-benzenetricarboxylic acid or acid anhydride thereof, or alkyl (1-12 carbon atoms) ester is preferable.

One kind of ≥2 valent carboxylic acid component may be used singly; alternatively, more than or equal to two kinds of ≥2 valent carboxylic acid components may be combined to be used.

In the manufacture process of polyester resin, esterification catalyst may be used to promote chemical reaction at the time of condensation polymerization of raw material monomers. As esterification catalyst, dibutyltin oxide and the like is exemplified.

As polystyrene resin, styrene polymer, copolymer of styrene and diene, copolymer of styrene and alkyl methacrylate, copolymer of styrene and alkyl acrylate and the like are exemplified.

Even among the abovementioned chemicals, considering of the excellent low temperature fixability, polyester resin is preferable as binder resin.

Tg of the binder resin is preferably 20~65 degrees centigrade, and more preferably 25~60 degrees centigrade.

Softening point of the binder resin is preferably 70~130 degrees centigrade, and more preferably 90~120 degrees centigrade from the viewpoint of fastness of the image and flavor generation from the printing object.

In the present specification, the softening point is, for example, a value measured by a flow tester (CFT-500D manufactured by Shimadzu Co., Ltd.).

One kind of binder resin may be used singly; alternatively, more than or equal to two kinds of binder resins may be combined to be used.

Content of the binder resin is preferably greater than 70 mass %, and more preferably 80~95 mass % with respect to the total amount of toner (100 mass %).

If the content of the binder resin is greater than a preferable lower limit value of the forgoing range, the fixability is better. On the other hand, if the content of the binder resin is smaller than a preferable upper limit value of the forgoing range, the flavor generation from the printing object is enhanced.

The toner of the embodiment may contain random raw material in addition to the binder resin and the perfume encapsulation microcapsule. As the random raw material, waxes, charge control agents, coloring agents, flocculants, external additives, surfactants, basic compounds, crosslinking agents, defoaming agents, antioxidants, pH adjusting agents and the like are exemplified.

As waxes, aliphatic hydrocarbon-based wax such as low molecular weight polyethylene, low molecular weight polypropylene, polyolefin copolymer, polyolefin wax, microcrystalline wax, paraffin wax, fischer-tropsch wax and the like; oxide of aliphatic hydrocarbon-based wax such as oxidized polyethylene wax and the like; or their block copolymer; vegetable wax such as candelilla wax, carnauba wax, Japan wax, jojoba wax, rice wax and the like; animal wax such as beeswax, lanolin, spermaceti and the like; mineral wax such as ozokerite, ceresin, petrolatum and the like; waxes taking fatty acid ester such as montanic acid ester wax and castor wax as main components; waxes deoxidizing some or all of fatty acid ester such as deoxidized carnauba wax; saturated straight chain fatty acid such as palmitic acid, stearic acid, montanic acid or long-chain alkyl carboxylic acid having even long-chain alkyl group and the like; unsaturated fatty acid such as brassidic acid, eleostearic acid and barinarin acid and the like; saturated alcohol such as stearyl alcohol, eicosyl alcohol, behenyl alcohol, carnaubyl alcohol, glyceryl alcohol, melissyl alcohol, or long-chain alkyl alcohol having even long-chain alkyl group; polyhydric alcohol such as sorbitol; fatty acid amide such as linoleic acid amide, oleic acid amide, lauric acid amide and the like; saturated fatty acid bisamide, such as methylene-bis-stearic acid amide, ethylene-bis-capric acid amide, ethylene-bis-lauric acid amide, hexamethylene-bis-stearic acid amide and the like; unsaturated fatty acid amides such as ethylene-bis-oleic acid amide, hexamethylene-bis-oleic acid amide, N,N'-dioleoyl adipic acid amide, N,N'-dioleoylsebacic acid amide and the like; aromatic bisamide such as m-xylene-bis-stearic acid amide, N,N'-distearyl isophthalic acid amide and the like; fatty acid metal salt (generally, referred to as metal soap) such as calcium stearate, calcium laurate, zinc stearate, magnesium stearate and the like; waxes in which aliphatic hydrocarbon wax is grafted with styrene or vinyl monomer such as acrylic acid; partial esters of polyhydric alcohols and fatty acids such as behenic acid monoglyceride; and methyl ester compounds having Hydroxy group and obtained by hydrogenating vegetable oil are exemplified.

One kind of wax may be used singly; alternatively, more than or equal to two kinds of waxes may be combined to be used.

Content of the wax is preferably 1~15 mass %, and more preferably 5~10 mass % with respect to the total amount of toner (100 mass %).

The charge control agent is used to control frictional charging charge quantity and make the transfer of the toner onto the image receiving medium such as paper easier. As the charge control agent, metal-containing azo compound and metal-containing salicylic acid derivative compound are exemplified. Even in the metal-containing azo compound, metal is preferably complex or complex salt of iron, chromium or cobalt, or their mixtures. Even in the metal-containing salicylic acid derivative compound, metal is preferably complex or complex salt of zirconium, zinc, chromium or boron, or their mixtures. One kind of charge control agent may be used singly; alternatively, more than or equal to two kinds of charge control agents may be combined to be used.

As the coloring agent, carbon black and organic or inorganic face dye are exemplified. As carbon black, acetylene black, furnace black, thermal black, channel black and ketjen black are exemplified. As face dye, fast yellow G, benzidine yellow, India fast orange, Irgazin red, naphthol azo, carmine FB, permanent bordeaux FRR, pigment orange R, lithol red 2G, lake red C, rhodamine FB, rhodamine B lake, phthalocyanine blue, pigment blue, brilliant green B, phthalocyanine green and quinacridone are exemplified. One kind of coloring agent may be used singly; alternatively, more than or equal to two kinds of coloring agents may be combined to be used.

The flocculant is mainly randomly used to promote agglomeration of raw materials with each other at the time of manufacturing the toner. As the flocculant, metal salt such as sodium chloride, calcium chloride, calcium nitrate, barium chloride, magnesium chloride, zinc chloride, magnesium sulfate, aluminum chloride, aluminum sulfate, potassium aluminum sulfate and the like; non-metal salt such as ammonium chloride, ammonium sulfate and the like; inorganic metal salt polymer such as polyaluminum chloride, polyaluminum hydroxide, calcium polysulfide and the like; polymer coagulant such as polymethacrylic acid ester, polyacrylic acid ester, polyacrylamide, acrylamide-sodium acrylate copolymer and the like; coagulant such as polyamine, polydiallyl ammonium halide, polydiallyl dialkyl ammonium halide, melanin formaldehyde condensates, dicyandiamide and the like; alcohol such as methanol, ethanol, 1-propanol, 2-propanol, 2-methyl-2-propanol, 2-methoxyethanol, 2-ethoxyethanol, 2-butoxyethano and the like; organic solvent such as acetonitrile, 1,4-dioxane and the like; inorganic acid such as hydrochloric acid, nitric acid and the like; and organic acid such as formic acid, acetic acid and the like are exemplified. Even in these chemicals, non-metal salt is preferable and ammonium sulfate is more preferable in order to enhance the effect of promoting the agglomeration. One kind of flocculant may be used singly; alternatively, more than or equal to two kinds of flocculants may be combined to be used.

According to the embodiment, the toner may be a toner obtained by mixing the external additive with toner particle for application of liquidity to the toner particle or adjustment of charging property. Further, by mixing the external additive with the toner particle, it is difficult to destroy the perfume encapsulation microcapsule during the image forming process. For example, inorganic particulate is used in the external additive. The volume average particle diameter of the inorganic particulate is preferably 5~1000 nm. As inorganic substance constituting the inorganic particulate, silica, titania, alumina, strontium titanate, tin oxide and the like are exemplified. One kind of inorganic substance may be used singly; alternatively, more than or equal to two kinds of inorganic substances may be combined to be used. Even among the external additives, one external additive obtained by conducting a surface treating on the inorganic particulate through a hydrophobic agent is preferable from the viewpoint of improving environment stability. Further, a resin particle of which particle diameter is below 1 μm may be used in the external additive to improve cleaning property. As resin constituting the resin particulate, styrene-acrylic acid copolymer, polymethyl methacrylate, melamine resin and the like are exemplified.

Hereinafter, according to the embodiment, a manufacture method of the toner is described.

A manufacture method (I) and a manufacture method (II) are exemplified as the manufacture method of the toner according to the embodiment.

Manufacture method (I): a situation (so-called a melt-kneading-pulverization method) that the toner particle is manufactured by pulverizing a kneaded product of the perfume encapsulation microcapsule and the melt of the raw material mixture containing the binder resin.

Manufacture method (II): a situation (so-called a wet granulation method) that the toner particle is manufactured by carrying out a granulation process of the raw material mixture containing the binder resin in an aqueous medium in which the perfume encapsulation microcapsule coexists.

Even in the manufacture methods of the toner described above, the manufacture method (II) is preferable. In a case of the manufacture method (II), the microstructure of the toner particle is easy to be formed, and homogenization of property of the toner particle is realized. In addition, compared with the manufacture method (I), in a case of the manufacture method (II), the perfume encapsulation microcapsule is difficult to be destroyed.

For example, a manufacture method (II-1) and a manufacture method (II-2) are exemplified as such a manufacture method (II).

Manufacture method (II-1): a situation that precursor monomer of the binder resin is polymerized to manufacture the toner particle in an aqueous medium in which the perfume encapsulation microcapsule disperses. Generally, suspension polymerization of vinyl polymerizable monomer is used.

Manufacture method (II-2): a situation that (so-called a wet agglomeration method) the toner particle is manufactured by heating agglomerated particle which agglomerates raw material mixture particle containing the binder resin and the perfume encapsulation microcapsule in an aqueous medium.

Even in the manufacture methods of the toner described above, the manufacture method (II-2) is preferable in particular from the viewpoint that it is possible to form the toner particle under a relatively low temperature condition and it is easy to suppress heat deterioration of the perfume encapsulation microcapsule.

Hereinafter, the manufacture method (II-2) is described according to the embodiment.

According to the embodiment, the manufacture method (II-2) has a toner particle preparation process which prepares the toner particle containing the perfume encapsulation microcapsule and the binder resin.

Hereinafter, the toner particle preparation process is described.

According to the embodiment, the toner particle preparation process includes an agglomeration operation and a fusion operation. By means of the agglomeration operation, in the aqueous medium, the agglomerated particle containing the perfume encapsulation microcapsule and the binder resin is prepared. By means of the fusion operation, a particle obtained by fusing the raw material mixture particles constituting the agglomerated particle with each other is prepared.

Hereinafter, the agglomeration operation is described.

In the agglomeration operation, perfume encapsulation microcapsule dispersion liquid and raw material mixture particle dispersion liquid are mixed to obtain the agglomerated particle. The raw material mixture particle dispersing in the raw material mixture particle dispersion liquid contains the binder resin and random raw materials other than the perfume encapsulation microcapsule and the binder resin as needed.

As the manufacture method of the perfume encapsulation microcapsule dispersion liquid, a method of capsuling the perfume is exemplified.

As the manufacture method of raw material mixture particle dispersion liquid, a method (i) for preparing each of dispersion liquids of the binder resin particle and random raw material particle (wax particle, charge control agent particle, colorant particle and the like), or a method (ii) for mixing each of dispersion liquids thereof is exemplified.

For example, the dispersion liquid of the binder resin particle is prepared by a polymerization method such as emulsion polymerization, seed polymerization, miniemulsion polymerization, suspension polymerization, interfacial polymerization, in-situ polymerization and the like; a phase inversion emulsification method; a mechanical emulsification method and the like.

For example, the dispersion liquid of the random raw material particle is prepared by a mechanical atomization method for mechanically atomizing the random raw material particle in the aqueous medium.

Further, as the manufacture method of the raw material mixture particle dispersion liquid, a method (iii) for mechanically atomizing pulverized objects obtained by melting and kneading, cooling and pulverizing the binder resin and the raw material in the aqueous medium is exemplified.

In a case of the method (iii), compared with the method (i) and the method (ii), process is simplified. In addition, in the method (iii), in a case where the raw material is used, the binder resin and the raw material are easy to be uniformly mixed.

Hereinafter, according to the embodiment, the method (iii) is described.

For example, the raw material mixture particle dispersion liquid is prepared by applying mechanical shearing force to the dispersion liquid obtained by adding the pulverized objects to dispersion medium.

As the dispersion medium of the raw material mixture particle dispersion liquid, water and mixed solvent medium of water and organic solvent medium are exemplified; among them, the water is preferable.

The volume average particle diameter of the pulverized objects is preferably above 10 μm and below 2 mm, and more preferably above 20 μm and below 1 mm.

The surfactant and the pH adjusting agent may be added in dispersion liquid obtained by adding the pulverized objects to dispersion medium. By adding the surfactant, the pulverized objects in the dispersion medium are easily dispersed through the function of the surfactant attached on the surface of the pulverized objects. As the pH adjusting agent, alkali is preferable. By adding the alkali as the pH adjusting agent, the dispersion property of the pulverized objects in the dispersion medium is improved.

It is preferable that a temperature condition at the time the mechanical shearing force is applied to the dispersion liquid is that the dispersion liquid is heated to be higher than the glass transition temperature of the binder resin.

A pressure condition at the time the mechanical shearing force is applied to the dispersion liquid is preferably 10~300 MPa.

As a machine used to apply the mechanical shearing force, a high-pressure pulverizer such as nanomizer (manufactured by Yoshida Kikai Co., Ltd.), ultimizer (manufactured by Sugino Machine Co., Ltd.), NANO3000 (manufactured by Bi-tsubu Co., Ltd.), microfluidizer (manufactured by Mizuho Industrial Co., Ltd.), homogenizer (manufactured by Izumi Food Machinery Co., Ltd.); a rotor-stator type stirrer such as ultra-turrax (manufactured by IKA Japan Co., Ltd.), TK auto-homomixer (manufactured by PRIMIX Co., Ltd.), TK pipe-line homomixer (manufactured by PRIMIX Co., Ltd.), TK Phil mix (manufactured by PRIMIX Co., Ltd.), Claire mix (manufactured by M Technique Co., Ltd.), Claire SS5 (manufactured by M Technique Co., Ltd.), cavitron (manufactured by Eurotech Co., Ltd.), fine flow mill (manufactured by Pacific Ocean Machinery & Engineering Co., Ltd.); and a media pulverizer such as visco mill (manufactured by Imex Co., Ltd.), apex mill (manufactured by Kotobuki Industrial Co., Ltd.), star mill (manufactured by Ashizawa Fine Tech Co., Ltd.), DCP super flow (manufactured by Japan Eirich Co., Ltd.), MP mill (manufactured by Inoue Co., Ltd.), spike mill (manufactured by Inoue Manufacturing Co., Ltd.), mighty mill (manufactured by Inoue Manufacturing Co., Ltd.), SC mill (manufactured by Mitsui Mining (Japan coke) Co., Ltd.) are exemplified.

The machine used to apply the mechanical shearing force may be used at the time of the agglutination operation described later.

After applying the mechanical shearing force to the dispersion liquid, the dispersion liquid is preferably cooled to a temperature smaller than the glass transition temperature of the binder resin. In this way, fine particle in the dispersion liquid is solidified.

Through the method mentioned above, the raw material mixture particle dispersion liquid is manufactured. The concentration of the raw material mixture particle in the raw material mixture particle dispersion liquid is preferably 20~50 mass %.

The volume average particle diameter of a raw material mixture particle group contained in the raw material mixture particle dispersion liquid is preferably 0.01~5 μm, and more preferably 0.05~2 μm. The volume average particle diameter of the raw material mixture particle group is preferably 0.1~70% of the volume average particle diameter of the perfume encapsulation microcapsule, and more preferably 0.5~50% thereof.

In the agglutination operation, the perfume encapsulation microcapsule dispersion liquid and the raw material mixture particle dispersion liquid are mixed. In this way, the perfume encapsulation microcapsule and the raw material mixture particle are agglutinated to generate the agglutination particle, and thus agglutination particle dispersion liquid is prepared.

The agglutination particle is formed in such a way as to coat the surface of the perfume encapsulation microcapsule with the raw material mixture particle. By forming such an agglutination particle, the perfume after the fixing processing is easy to be housed in the toner and the effect of granting flavor to printing object is higher.

The perfume encapsulation microcapsule dispersion liquid and the raw material mixture particle dispersion liquid are preferably blent in such a manner that a rate of the perfume encapsulation microcapsule is preferably 0.5~30 pts·mass, and more preferably 1~15 pts·mass with respect to 100 pts·mass of the raw material mixture particle.

In the agglutination operation, a temperature condition when the perfume encapsulation microcapsule dispersion liquid and the raw material mixture particle dispersion liquid are mixed is preferably 25~50 degrees centigrade.

A certain amount of the raw material mixture particle dispersion liquid may be continuously added, or intermittently added with respect to the perfume encapsulation microcapsule dispersion liquid. As the surface of the perfume encapsulation microcapsule is thickly coated with the raw material mixture particle, it is preferable that the raw material mixture particle dispersion liquid of a certain amount is continuously added. In a case of continuously adding the raw material mixture particle dispersion liquid of a certain amount, it is preferable that the raw material mixture particle dispersion liquid is added at a certain adding speed with respect to the perfume encapsulation microcapsule dispersion liquid.

When the perfume encapsulation microcapsule dispersion liquid and the raw material mixture particle dispersion liquid are mixed, the random raw material may be added as needed. For example, as the random raw material, the flocculant, the surfactant and the pH adjusting agent are exemplified. The particle diameter of the toner obtained eventually is more uniform by means of the addition of the random raw material.

Hereinafter, the fusion operation is described.

In the fusion operation, the agglutination particle dispersion liquid obtained by the agglutination operation is heated at a random temperature. In this way, a liquid (fused particle dispersion liquid), in which particle of which the raw material mixture particles coating the surface of the perfume encapsulation microcapsule are melted is dispersed, is prepared.

A temperature condition at the time the agglutination particle dispersion liquid is heated is preferably greater than the glass transition temperature of the binder resin. For example, the temperature condition at the time the agglutination particle dispersion liquid is heated is preferably 40~95 degrees centigrade. Further, the temperature condition at the time the agglutination particle dispersion liquid is heated is preferably above 10 degrees centigrade higher than the temperature condition at the agglutination operation. The heating time is preferably 2~10 hours.

According to the embodiment, the toner particle preparation process may still have a cleaning operation or a drying operation, in addition to the agglutination operation and the fusion operation.

In the cleaning operation, the fused particle obtained by the fusion operation is cleaned. The cleaning operation is properly carried out by a well-known cleaning method. For example, in the cleaning operation, centrifuge, filter press and the like are suitably used. Further, in the cleaning operation, as cleaning solution, water, ion-exchange water, purified water, water adjusted to acidity, water adjusted to base and the like are used. The cleaning operation is carried out by repeating the cleaning and filtration through the cleaning solution for the fused particle. The cleaning operation is preferably repeated until the conductivity of the filtrate is below 50 μS/cm.

In the drying operation, the fused particle after the fusion operation or the cleaning operation is dried. The drying operation is carried out by a well-known drying method. For example, in the drying operation, a vacuum drier, an air current drier, a fluid drier and the like are suitably used. The drying operation is carried out until moisture content of the fused particle is preferably below 1.0 mass %.

The toner particle is prepared by the toner particle preparation process according to the forgoing embodiment. The prepared toner particle itself may be used as a toner.

According to the embodiment, the manufacture method (II-2) may include an external addition process in addition to the toner particle preparation process.

Hereinafter, the external addition process is described.

In the external addition process, the toner particle group and the external additive are mixed to obtain a toner particle group coated by the external additive.

Blending amount of the external additive is preferably 0.01~20 pts·mass with respect to 100 pts·mass of the toner particle.

As a mixer used at the time the toner particle group and the external additive are mixed, a henschel mixer (manufactured by Mitsui Mining (Japan coke) Co., Ltd.), a super mixer (manufactured by Kawata Co., Ltd.), ribokon (manufactured by Okawara manufacturing Co., Ltd.), a Nauta mixer (manufactured by Hosokawa Micron Co., Ltd.), a turbulizer (manufactured by Hosokawa Micron Co., Ltd.), a cyclomix (manufactured by Hosokawa Micron Co., Ltd.), a spiral pin mixer (manufactured by Pacific Ocean Machinery & Engineering Co., Ltd.), and Lodige mixer (manufactured by Matsubo Co., Ltd.) are exemplified.

In the manufacture method (II-2) according to the embodiment, after the agglutination operation, the agglutination particle dispersion liquid and the binder resin particle dispersion liquid may be fixed. In this way, the agglutination particle and the binder resin particle are agglutinated. By adhering the binder resin particle to the surface of the agglutination particle, the surface of the perfume encapsulation microcapsule is further coated. Therefore, the perfume encapsulation microcapsule is more difficult to be destroyed during the image forming process.

In the manufacture method (II-2) according to the embodiment, after the fusion operation, the fused particle dispersion liquid and the binder resin particle dispersion liquid may be mixed. In this way, the fused particle and the binder resin particle are agglutinated. By adhering the binder resin particle to the surface of the fused particle, the surface of the perfume encapsulation microcapsule is further coated. Therefore, the perfume encapsulation microcapsule is more difficult to be destroyed during the image forming process.

Hereinafter, the image forming apparatus according to the embodiment is described with reference to the accompanying drawings.

FIG. 1 is a schematic diagram illustrating outline structure of the image forming apparatus according to the embodiment.

As shown in FIG. 1, an image forming apparatus 20 has an apparatus main body equipped with an intermediate transfer belt 7, a first image forming unit 17A, a second image forming unit 17B arranged sequentially on the intermediate transfer belt 7 and a fixing device 30 arranged at the downstream side of these devices described above. The first image forming unit 17A is arranged at the downstream side of the second image forming unit 17B along a moving direction of the intermediate transfer belt 7, that is, an advancing direction of an image forming process. The fixing device 30 is arranged at the downstream side of the first image forming unit 17A.

The first image forming unit 17A is provided with a photoconductive drum 1*a*, a cleaning device 16*a*, a charging device 2*a*, an exposure device 3*a*, a first developing device 4*a*, which are arranged sequentially on the photoconductive drum 1*a*, and a primary transfer roller 8*a* arranged to face the photoconductive drum 1*a* across the intermediate transfer belt 7.

The second image forming unit 17B is provided with a photoconductive drum 1*b*, a cleaning device 16*b*, a charging device 2*b*, an exposure device 3*b*, a second developing device 4*b*, which are arranged sequentially on the photoconductive drum 1*b*, and a primary transfer roller 8*b* arranged to face the photoconductive drum 1*b* across the intermediate transfer belt 7.

A toner in the embodiment described above is housed in at least one of the first developing device 4*a* and the second developing device 4*b*. The toner may be supplied from a toner cartridge (not shown).

The image forming apparatus 20 shown in FIG. 1 has two developing devices 4*a* and 4*b*, but may have more than or equal to three developing devices according to the category of the used toners.

A primary transfer power supply 14*a* is connected with the primary transfer roller 8*a*. A primary transfer power supply 14*b* is connected with the primary transfer roller 8*b*.

A second transfer roller 9 and a backup roller 10 are arranged to face each other at the downstream side of the first image forming unit 17A across the intermediate transfer belt 7. A second transfer power supply 15 is connected with the second transfer roller 9.

The fixing device 30 shown in FIG. 1 includes a fixing roller 31 and a pressure roller 32 arranged to face each other.

Figure 2:
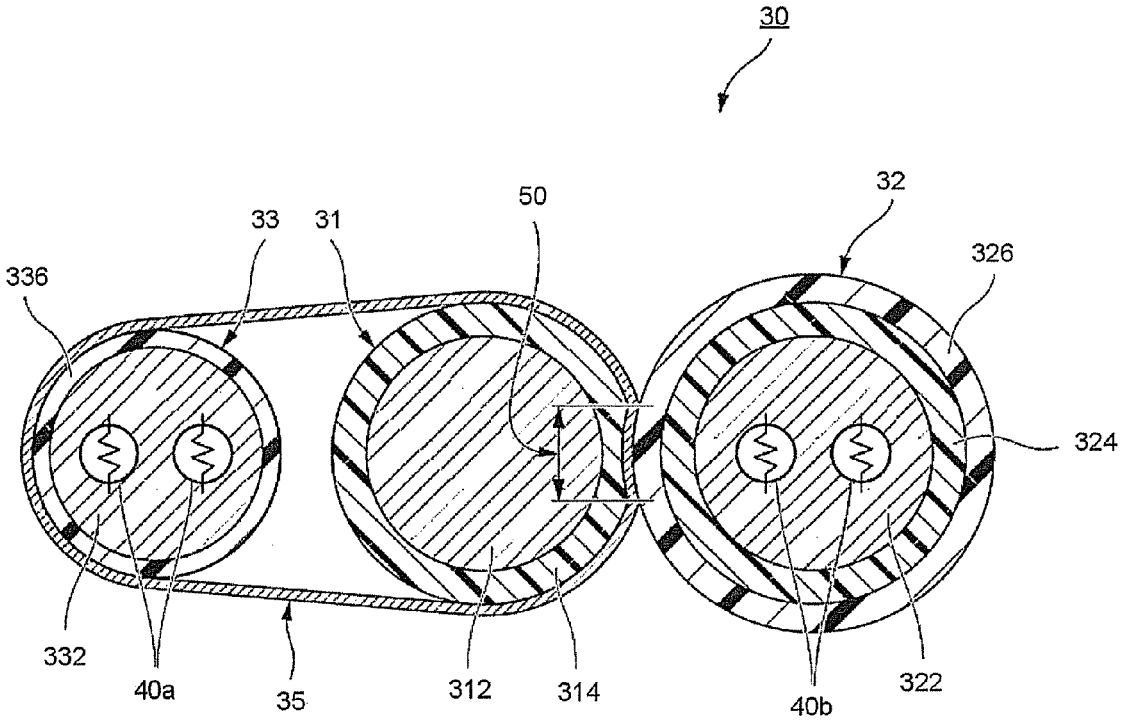
FIG. 2 is a diagram illustrating an embodiment of a fixing device.

FIG. 2 is a cross-sectional view illustrating the outline structure of the fixing device according to the embodiment.

The fixing device 30 shown in FIG. 2 is applicable to the image forming apparatus 20 shown in FIG. 1.

The fixing device 30, which is a heating belt fixing system, includes the fixing roller 31, the pressure roller 32, a heating roller 33 and a fixing belt 35.

The fixing roller 31 is a rotation member, so-called sponge roller equipped with a core shaft 312 made of metal and a sponge layer 314 arranged on the core shaft 312.

The thickness of the sponge layer 314 is suitably set considering of the dimension of the fixing roller 31 and the hardness of the sponge layer 314 (sponge hardness).

The heating roller 33 is a rotation member provided with a core shaft 332 made of metal and a releasing layer 336 arranged on the core shaft 332. Heater lamps 40*a* are arranged inside the core shaft 332 of the heating roller 33.

The fixing belt 35, which is an endless shape, is suspended by the fixing roller 31 and the heating roller 33 and assumed to be rotatable.

The pressure roller 32 is a rotation member consisting of a core shaft 322 made of metal, an elastic layer 324 arranged on the core shaft 322 and a releasing layer 326 arranged on the elastic layer 324. Heater lamps 40*b* are arranged inside the core shaft 322 of the pressure roller 32.

The pressure roller 32 is arranged to be opposite to the fixing roller 31 through the fixing belt 35. The pressure roller 32 energizes the fixing roller 31 side through a pressure spring (not shown). In this way, a nip part 50 is formed by the connection of the fixing roller 31 and the pressure roller 32 via the fixing belt 35 along the circumferential surface of the fixing roller 31.

The energizing force generated by the pressure spring is suitably set considering of the dimension of each of the rollers and the sponge hardness.

In the present specification, a width of the nip part 50 (nip part width) is measured as follows. In the fixing device 30 during a fixing operation, an image receiving medium on which a toner image is recorded passes a position between the fixing belt 35 and the pressure roller 32 along the circumferential surface of the fixing roller 31, and the fixing operation is stopped during the passing process of the image receiving medium. Then, the image receiving medium is sandwiched between the fixing belt 35 and the pressure roller 32 for a certain time. In this way, in the toner image part on the image receiving medium, a gloss difference occurs due to the existence of a sandwiching part and non-sandwiching part. A lateral direction of a range (substantially rectangle) where the gloss difference occurs is measured as the width of the nip part 50 (nip part width).

The width of the nip part 50 (nip part width) is suitably set considering of the dimension of each of the rollers, the sponge hardness and the energizing force generated by the pressure spring.

For example, in the fixing device 30 according to the embodiment, the outer diameter of the fixing roller 31 is 38 mm. the outer diameter of the pressure roller 32 is 38 mm. The outer diameter of the heating roller 33 is 40 mm.

The thickness of the sponge layer 314 is preferably 5~15 mm.

The hardness of the sponge layer 314 (sponge hardness) is preferably 20~50 degrees, and more preferably 25~45 degrees. If the sponge hardness is above a preferable lower limit value of the range, the fixability is further improved. On the other hand, if the sponge hardness is below a preferable upper limit value of the range, the perfume encapsulation microcapsule is more difficult to be destroyed and the perfume is easier to be kept in the toner.

The energizing force generated by the pressure spring is preferably more than 100N, and more preferably 200~600N. If the energizing force generated by the pressure spring is above a preferable lower limit value of the range, the fixability is further improved. On the other hand, if the energizing force generated by the pressure spring is below a preferable upper limit value of the range, the perfume encapsulation microcapsule is more difficult to be destroyed and the perfume is easier to be kept in the toner.

The width of the nip part 50 (nip part width) is preferably greater than 7.5 mm, and more preferably 7.5~11 mm.

In the present specification, the pressure applied to the image receiving medium passing through the nip part 50 is a value obtained by dividing the energizing force generated by the pressure spring by the area of the nip part 50. The area of the nip part 50 (substantially rectangle) is assumed to be a value obtained by multiplying the nip part width and the length in a longitudinal direction of the nip part 50.

The pressure applied to the image receiving medium passing through the nip part 50 is preferably below 0.19 $N/mm^2$, and more preferably 0.10~0.19 $N/mm^2$. If the pressure applied to the image receiving medium is below a preferable upper limit value of the range, the perfume encapsulation microcapsule is difficult to be destroyed and the perfume is easy to be kept in the toner after fixing processing. On the other hand, if the pressure applied to the image receiving medium is above a preferable lower limit value of the range, the fixability and fastness are easier to be guaranteed.

The fixing device of the image forming apparatus according to the embodiment, which is not limited to the heating belt fixing system, may be a heating roller fixing system. In the heating roller fixing system, the fixing roller and the pressure roller are directly connected with each other and the nip part is formed therebetween.

In the image forming apparatus according to the embodiment, the toner which contains the perfume encapsulation microcapsule and the binder resin and of which the glass transition temperature is below 60 degrees centigrade is housed in the developing device. The toner is used, and thus it is possible to carry out fixing processing at a lower temperature and it is difficult to generate evaporation of the perfume at the time of the fixing processing.

In addition, in the image forming apparatus according to the embodiment, the pressure applied to the image receiving medium passing through the nip part is smaller than 0.19 $N/mm^2$. Therefore, the damage of the perfume encapsulation microcapsule can be suppressed under the pressure applied to the image receiving medium at the time of the fixing processing.

In accordance with such an image forming apparatus of the embodiment, as the perfume is easier to be kept in the toner after the fixing processing, the effect of granting flavor to the printing object is excellent.

Hereinafter, an image forming method of the embodiment is described.

According to the embodiment, the image informing method uses the image forming apparatus of the embodiment mentioned above to transfer the toner image consisting of the toner onto the image receiving medium and then to form the image through fixing the image toner. A pressure smaller than 0.19 $N/mm^2$ is applied to the image receiving medium passing through the nip part formed by the fixing roller and the pressure roller.

For example, an image forming operation is carried out described later with the use of the image forming apparatus 20 equipped with the fixing device 30 of FIG. 2.

Further, in the image forming apparatus 20, the toner containing the perfume encapsulation microcapsule is housed in either of the developing device 4*a* and the developing device 4*b*. The perfume encapsulation microcapsules contained respectively in the toner (toner a) housed in the developing device 4*a* and the toner (toner b) housed in the developing device 4*b* may be identical to each other, or different from each other.

First, the photoconductive drum 1*b* is uniformly charged by the charging device 2*b*.

Next, an exposure is carried out by the exposure device 3*b* to form an electrostatic latent image on the photoconductive drum 1*b*. And then a development is carried out by the image supplied from the developing device 4*b* to obtain a second toner image.

Sequentially, the photoconductive drum 1*a* is uniformly charged by the charging device 2*a*.

Then, an exposure is carried out based on a first image information (second toner image) by the exposure device 3*a* to form an electrostatic latent image on the photoconductive drum 1*a*. And then a development is carried out by the image supplied from the developing device 4*a* to obtain a first toner image.

The second toner image and the first toner image are in sequence transferred onto the intermediate transfer belt 7 with the use of the primary transfer rollers 8*a* and 8*b*.

An image obtained by laminating the second toner image and the first toner image in sequence on the intermediate transfer belt 7 is secondarily transferred onto the image receiving medium (not shown) through the secondary transfer roller 9 and the backup roller 10.

The image receiving medium on which the toner image is secondarily transferred is sent to the fixing device 30 and passes through a position (nip part 50) between the fixing belt 35 and the pressure roller 32 along the circumference surface of the fixing roller 31. At this time, the width (nip part width) of the nip part 50 is preferably greater than 7.5 mm. The pressure applied to the image receiving medium passing through the nip part 50 is suppressed to be smaller than 0.19 $N/mm^2$, and the toner image is heated and pressured to be fixed on the image receiving medium.

A temperature condition at the time of such a fixing process and linear speed condition of the fixing belt 35 are respectively suitably set to a fixable condition under which an offset does not occur.

As stated above, the image obtained by laminating the first toner image and the second toner image is formed on the image receiving medium. In the image formed described above, the perfume is volatilized from the image part and the flavor is sufficiently recognized.

Hereinafter, an image forming method according to other embodiment is described.

As the image forming method according to the other embodiment, it is exemplified that there is a form of using an image forming apparatus in which a toner p containing the perfume encapsulation microcapsule is housed in one developing device of the developing device 4*a* and the developing device 4*b*, and a toner q containing no perfume encapsulation microcapsule is housed in the other developing device. In this case, the toner p may be housed in either of the developing device 4*a* or the developing device 4*b*. The toner q may be housed in either of the developing device 4*a* or the developing device 4*b*. In a case in which the toner p is housed in the developing device 4*b* and the toner q is housed in the developing device 4*a*, the second toner image through the toner p exists on the surface side of the image. The image formed in this way, the flavor is easier to be recognized.

Further, as an image forming method according to the other embodiment, it is also exemplified that there is a form of using an image forming apparatus in which the toner p is housed in one developing device of the developing device 4*a* and the developing device 4*b* and the toner is not housed in the other developing device.

In accordance with the image forming method according to the embodiment, as the effect of granting flavor to the printing object is excellent, the flavor from the printing object is sufficiently recognized.

In accordance with at least one embodiment described above, an image forming apparatus is used, including a fixing device in which a specific toner is housed in the developing device and a pressure smaller than 0.19 $N/mm^2$ is applied to the image receiving medium passing through a nip part. By using such an image forming apparatus, a fixing processing is carried out at a lower temperature condition. In addition, the pressure applied to the image receiving medium is suppressed to be lower. Thus, an effect of granting flavor to a printing object is excellent, and the flavor from the printing object is sufficiently recognized.

The following example is described as an example of the embodiment. However, the embodiment is not limited to the present example.

Hereinafter, an image forming method is described.

A developing agent is manufactured by mixing a toner (1) or a toner (2) with a ferrite carrier coated by silicone resin. At this time, the concentration of the ferrite carrier in the developing agent is set to 8 pts·mass of the ferrite carrier with respect to 100 pts·mass of the toner.

An image forming apparatus uses the same form as the image forming apparatus 20 shown in FIG. 1. A fixing device shown in FIG. 2 is applicable to the fixing device 30 of the image forming apparatus 20.

Actually, image forming apparatuses equipped with an electrophotographic multiple functional printer (manufactured by Toshiba Tec Co., Ltd., e-studio-2050c) set for acquiring an unfixed image and each of fixing devices (1)~(3) described later are respectively used. The developing agent is housed in one of developing devices of the electrophotographic MFP (e-studio-2050c).

Using the image forming apparatus where the developing agent is housed in the developing device, an unfixed toner image is transferred onto a paper of which a basis amount is 90 g in such a manner that an adhesion amount of the toner is 0.45 $mg/cm^2$. Next, with the use of each fixing device, the unfixed toner image transfer onto the paper is fixed at a linear speed 75 mm/sec. of the fixing belt and a predetermined fixing temperature (135 degrees centigrade or 150 degrees centigrade) to form an image. In a case of using the toner (1), the fixing temperature is set to 135 degrees centigrade. In a case of using the toner (2), the fixing temperature is set to 150 degrees centigrade. The fixing processing is possible without the occurrence of the offset if the predetermined fixing temperature is 135 degrees centigrade or 150 degrees centigrade.

Hereinafter, an evaluation of the flavor of the printing object is described.

The image formed through the above-mentioned image forming method is placed for a week. Then, the image part placed for a week is rubbed by a finger to evaluate the strength of the flavor smelled from the finger. The evaluation standard of the strength of the flavor is as follows.

A: even if a distance from a nose to the paper is about 30 cm, the flavor can be sufficiently recognized.

B: even if the distance from the nose to the paper is about 30 cm, the flavor can be a little recognized, and if the paper approaches the nose, the flavor can be sufficiently recognized.

C: if the distance from the nose to the paper is about 30 cm, the flavor can be very slightly recognized, and if the paper approaches the nose, the flavor can be a little recognized.

D: if the distance from the nose to the paper is about 30 cm, the flavor cannot be recognized; however, if the paper approaches the nose, the flavor can be very slightly recognized.

E: if the paper approaches the nose, the flavor can be very slightly recognized or cannot be recognized.

Hereinafter, a toner used in the present example is described.

Hereinafter, a manufacture method of perfume encapsulation microcapsule dispersion liquid is described.

Oily perfume (manufactured by Ogawa Perfume Co., Ltd., ORANGE-CS OIL IT) is used as encapsulation substance of the perfume encapsulation microcapsule.

Methylol-melamine resin is used as the material of the wall film of the perfume encapsulation microcapsule. Specifically, water is added in methylol-melamine resin aqueous solution (manufactured by Sumitomo Chemical Co., Ltd., commodity name "sumirez resin" 613; 80 mass % of resin concentration) and the resin aqueous solution adjusted to 17 mass % of resin concentration is used. Moreover, water is added in the sumirez resin 613 and the resin aqueous solution adjusted to 25 mass % of resin concentration is used.

Firstly, Ethylene-maleic anhydride copolymer (Monsanto Chemicals Co., Ltd., commodity name EMA-31) is added with water and heated and hydrolyzed to obtain 5 mass % aqueous solution (EMA). PH of the 5 mass % aqueous solution (EMA) is adjusted to 4.5.

Next, the oily perfume 100 mL is added in the 5 mass % aqueous solution (EMA) 100 g to make it emulsified and dispersed using a homogenizer. In this way, 2~3 μm oil droplets are dispersed to obtain emulsion dispersion liquid.

Then, 50 g of resin aqueous solution (17 mass % of resin concentration) is added in the emulsion dispersion liquid while stirring the emulsion dispersion liquid, and then the stir is continued for 2 hours at a temperature of system 55 degrees centigrade to obtain suspension liquid. In this way, methylol-melamine resin polymerization phase precipitated in the system is attached on the surface of the oil droplets of the oily perfume, and then a microcapsule primary film is formed.

Next, the suspension liquid is cooled to a room temperature, and pH of the suspension liquid is lowered to 3.5 while the stir is continued.

Sequentially, 80 g of resin aqueous solution (25 mass % of resin concentration) is added in the suspension liquid of which pH is lowered to 3.5 and the temperature of the system rises to 50~60 degrees centigrade.

After temperature rises, the stir is continued for 1 hour. In this way, concentration polymerization phase containing needle-like fine pieces of methylol-melamine resin precipitated in the system is attached on the surface of the microcapsule primary film, and then microcapsule secondary film is formed.

Next, after adjusting the temperature of this system to the room temperature, 400 g water is added. Through the addition of the water, the secondary film is fully hardened.

In this way, the perfume encapsulation microcapsule dispersion liquid is obtained. The volume average particle diameter of the perfume encapsulation microcapsule in such a dispersion liquid measured by SALD 7000 manufactured by Shimadzu Co., Ltd. is 2.0 μm.

Hereinafter, a manufacture method of toner component dispersion liquid (R1) is described.

94 pts·mass of polyester resin (glass transition temperature 57 degrees centigrade, softening point 105 degrees centigrade) as binder resin, 5 pts·mass of rice wax as a wax and 1 pts·mass of charge control agent (manufactured by Hodogaya Chemical Co., Ltd., TN-105) are uniformly mixed using a dry mixer to obtain a raw material mixture.

Sequentially, using a biaxial kneading machine (manufactured by Ikegai Iron Works Co., Ltd., PCM-45), the raw material mixture is melted and kneaded at 80 degrees centigrade to obtain a melt-kneaded substance.

Next, the melt-kneaded substance is cooled and pulverized to 2 mm mesh pass by a pin mill, and further pulverized by bantam mill to obtain a pulverized material having a volume average particle diameter 50 μm.

Moreover, 0.9 pts·mass of dodecyl benzene sulfonate sodium as a surfactant, 0.45 pts·mass of dimethyl amino ethanol as pH adjusting agent and 68.65 pts·mass of ion-exchanged water are mixed to obtain a surfactant aqueous solution.

Next, 30 pts·mass of the pulverized material of the volume average particle diameter 50 μm is dispersed with respect to 100 pts·mass of surfactant aqueous solution, and vacuum degassing is carried out to obtain pulverized material dispersion liquid.

With the use of a high-pressure emulsification device (manufactured by Bi-tsubu Co., Ltd., NANO3000), an atomization processing is carried out for the pulverized material dispersion liquid under the condition of 180 degrees centigrade and 150 MPa. Further, in the a high-pressure emulsification device (manufactured by Bi-tsubu Co., Ltd., NANO3000), a 12 m high-pressure pipe for heat exchange immersed in an oil bath as a heating section, a high-pressure pipe of which nozzles of each of diameters 0.13 μm and 0.28 μm are continuously mounted as a pressure section, a medium-pressure pipe of which cells having each of pore diameters 0.4 μm, 1.0 μm, 0.75 μm, 1.5 μm, 1.0 μm are continuously mounted as a pressure reducing section and a 12 m heat exchange pipe capable of cooling in tap water as a cooling section are arranged.

Sequentially, the high-pressure emulsification device is decompressed while maintained at 180 degrees centigrade, and then cooled to 30 degrees centigrade.

As stated above, the toner component dispersion liquid (R1) is obtained as raw material mixture particle dispersion liquid. The volume average particle diameter of particle group of toner component of such a toner component dispersion liquid (R1) is 0.3 μm, which is measured by SALD 7000 manufactured by Shimadzu Co.

Hereafter, a manufacture method of toner component dispersion liquid (R2) is described.

In addition to changing the binder resin from polyester resin (glass transition temperature 57 degrees centigrade, softening point 105 degrees centigrade) to the polyester resin (glass transition temperature 67 degrees centigrade, softening point 135 degrees centigrade), the toner component dispersion liquid (R2) is manufactured through a method similarly to the manufacture method of toner component dispersion liquid (R1).

The volume average particle diameter of particle group of toner component of such a toner component dispersion liquid (R2) is 0.5 μm, which is measured by SALD 7000 manufactured by Shimadzu Co.

Hereinafter, a manufacture method of toner (1) is described.

Toner particle preparation process:

2.5 pts·mass of polydiallyldimethylammonium ammonium chloride solution of 0.5 mass % is added in 1.5 pts·mass of the perfume encapsulation microcapsule dispersion liquid together with stir at 6500 rpm using a homogenizer (manufactured by IKA) Further, 5 pts·mass of ammonium sulfate solution of 30 mass % is added while the stir is continued to obtain a dispersion liquid for dispersing perfume encapsulation microcapsule. Sequentially, in a stirred tank of capacity 1L in which paddle blades are arranged, the temperature of the dispersion liquid rises to 40 degrees centigrade together with stir at 800 rpm, and then the stir is continued for 1 hour at 40 degrees centigrade Next, a solution in which 16 pts·mass of toner component dispersion liquid (R1) and 83 pts·mass of ion exchange water are mixed is slowly added in the dispersion liquid during 10 hours while the stir is continued. Then, 10 pts·mass of polycarboxylic acid sodium salt solution of 10 mass % is added to obtain agglutination particle dispersion liquid (agglutination operation).

Sequentially, the agglutination particle dispersion liquid is heated to 68 degrees centigrade and placed for one hour. Then, the agglutination particle dispersion liquid is cooled to obtain fused particle dispersion liquid (fusion operation).

Operations of filtration and washing with the ion exchange water are repeatedly carried out for the fused particle dispersion liquid until conductivity of filtrate is 50 μS/cm (washing operation).

Then, filter cake is dried by a vacuum drier until moisture content is below 1.0 mass % to obtain a toner particle group (drying operation). The volume average particle diameter of the obtained toner particle group is 7.8 μm.

External Addition Process:

Next, 2 pts·mass of hydrophobic silica and 0.5 pts·mass of titanium oxide are respectively added in 100 pts·mass of the obtained toner particle group to be mixed and then to obtain the toner (1).

The glass transition temperature (Tg) of the toner (1) obtained eventually is 54 degrees centigrade with DSC.

Hereinafter, a manufacture method of a toner (2) is described.

In addition to changing the toner component dispersion liquid (R1) to the toner component dispersion liquid (R2), the toner is manufactured through a method similarly to the manufacture method of the toner (1).

The volume average particle diameter of the toner particle group is 8.4 μm after the drying operation.

Tg of the toner (2) obtained eventually is 63 degrees centigrade with DSC.

Hereinafter, fixing devices (1)~(3) used in the present example are described.

Specification common in the fixing devices (1)~(3) is as follows.

Fixing roller: silicone sponge roll. Outer diameter of roller is 38 mm and thickness of sponge layer is 8 mm.

Heating roller: outer diameter of roller is 38 mm. The roller has an aluminum metal core and a perfluoroalkoxy fluorine resin (PFA) tube layer (thickness 30 μm) arranged on the metal core.

Fixing belt: it has a nickel electroformed layer (thickness 40 μm) as a base material, a silicone rubber layer (thickness 300 μm) arranged on the base material and a PFA tube layer (thickness 30 μm) arranged on the silicone rubber layer.

Pressure roller: outer diameter of the roller is 40 mm. The roller has an iron metal core, a rubber layer (thickness 2 mm) arranged on the metal core and a PFA tube layer (thickness 30 μm) arranged on the rubber layer.

In the fixing device (1), it is assumed that the sponge hardness of the fixing roller is 40 degrees, and a pressure spring which generates an energizing force 400N is adopted between the fixing roller and the pressure roller. It is assumed that the nip part width of the fixing device (1) is 7.7 mm and the pressure applied to the image receiving medium passing through the nip part is 0.16 N/mm$^2$.

In the fixing device (2), it is assumed that the sponge hardness of the fixing roller is 40 degrees, and a pressure spring which generates an energizing force 500N is adopted between the fixing roller and the pressure roller. It is assumed that the nip part width of the fixing device (2) is 8.4 mm and the pressure applied to the image receiving medium passing through the nip part is 0.19 N/mm$^2$.

In the fixing device (3), it is assumed that the sponge hardness of the fixing roller is 45 degrees, and a pressure spring which generates an energizing force 500N is adopted between the fixing roller and the pressure roller. It is assumed that the nip part width of the fixing device (3) is 7.4 mm and the pressure applied to the image receiving medium passing through the nip part is 0.21 N/mm$^2$.

Hereinafter, an image forming apparatus used in the present example is described.

Example 1

An image forming apparatus is used which is equipped with a developing device for storing the toner (1) and the fixing device (1) and in which pressure applied to the paper passing through the nip part is 0.16 N/mm$^2$.

Example 2

An image forming apparatus is used which is equipped with the developing device for storing the toner (1) and the fixing device (2) and in which pressure applied to the paper passing through the nip part is 0.19 N/mm$^2$.

Comparative Example 1

An image forming apparatus is used which is equipped with the developing device for storing the toner (1) and the fixing device (3) and in which pressure applied to the paper passing through the nip part is 0.21 N/mm$^2$.

Comparative Example 2

An image forming apparatus is used which is equipped with a developing device for storing the toner (2) and the fixing device (1) and in which pressure applied to the paper passing through the nip part is 0.16 N/mm$^2$.

Comparative Example 3

An image forming apparatus is used which is equipped with the developing device for storing the toner (2) and the fixing device (3) and in which pressure applied to the paper passing through the nip part is 0.21 N/mm$^2$.

FIG. 3 shows evaluation results of the flavor of the printing object and the image forming apparatus of each example.

In a case of using the image forming apparatus of the comparative example 1 in which the pressure applied to the paper passing through the nip part is larger than 0.19 N/mm$^2$, there is a result that the evaluation of the flavor of the printing object is slightly lower.

In a case of using the image forming apparatus of the comparative example 2 in which Tg of toner is greater than 60 degrees centigrade, there is a result that the evaluation of the flavor of the printing object is lower than that of the comparative example 1.

In a case of using the image forming apparatus of the comparative example 3 in which the pressure applied to the paper passing through the nip part is larger than 0.19 N/mm$^2$ and Tg of toner is greater than 60 degrees centigrade, there is a result that the evaluation of the flavor of the printing object is also lower than that of the comparative example 1.

On the other hand, in a case of using the image forming apparatus of the examples 1 and 2 applied to the present embodiment, the evaluation of the flavor of the printing object is high and the effect of granting flavor to the printing object is excellent.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus, comprising:

a developing device configured to house a toner; and a fixing device configured to include a fixing roller and a pressure roller, wherein the toner contains binder resin and a microcapsule in which perfume is encapsulated, and a glass transition temperature of the toner is below 60 degrees centigrade; and a nip part is formed by the fixing roller and the pressure roller, and pressure applied to an image receiving medium passing through the nip part is below 0.19 N/mm$^2$.

2. The image forming apparatus according to claim 1, wherein a glass transition temperature of the toner is above 25 degrees centigrade.

3. The image forming apparatus according to claim 1, wherein a glass transition temperature of the binder resin is 20~65 degrees centigrade.

4. The image forming apparatus according to claim 1, wherein a volume average particle diameter of the toner is 3~20 μm.

5. The image forming apparatus according to claim 1, wherein a volume average particle diameter of the microcapsule is 0.10~10 μm.

6. The image forming apparatus according to claim 1, wherein content of the microcapsule in the toner is 1~20 mass %.

7. The image forming apparatus according to claim 1, wherein the perfume is liquid.

8. The image forming apparatus according to claim 1, wherein wall film of the microcapsule contains at least one kind of material selected from a group consisting of melamine-formaldehyde resin and urethane resin.

9. The image forming apparatus according to claim 1, wherein a width of the nip part formed by the fixing roller and the pressure roller is above 7.5 mm.

10. An image forming method using the image forming apparatus according to claim 1, wherein transferring a toner image consisting of the toner onto the image receiving medium;

applying pressure smaller than 0.19 $N/mm^2$ to the image receiving medium passing through the nip part; and fixing the toner image on the image receiving medium.

* * * * *